US006139287A

United States Patent [19]

Kuroiwa et al.

[11] Patent Number: 6,139,287

[45] Date of Patent: Oct. 31, 2000

[54] SCROLL TYPE FLUID MACHINE

[75] Inventors: Hiroyuki Kuroiwa; Shigeki Hagiwara, both of Sakai, Japan

[73] Assignee: Daikin Industries, Ltd., Osaka, Japan

[21] Appl. No.: 09/180,249

[22] PCT Filed: Jun. 11, 1997

[86] PCT No.: PCT/JP97/02013

§ 371 Date: Nov. 3, 1998

§ 102(e) Date: Nov. 3, 1998

[87] PCT Pub. No.: WO98/57066

PCT Pub. Date: Dec. 17, 1998

[51] Int. Cl.[7] ..... F04B 49/00; F01C 1/02

[52] U.S. Cl. ..... 417/310; 417/299; 418/55.1

[58] Field of Search ..... 417/299, 307, 417/308, 310, 440; 418/55.1, 57, 5, 6, 54; 62/58

[56] References Cited

U.S. PATENT DOCUMENTS 4,382,370 5/1983 Suefuji et al. ..... 62/324.1
4,714,415 12/1987 Mizuno et al. ..... 418/14

FOREIGN PATENT DOCUMENTS 2-55636 11/1990 Japan .
9-42178 2/1997 Japan .
9-79151 3/1997 Japan .
9-170573 6/1997 Japan .

*Primary Examiner*—Teresa Walberg
*Assistant Examiner*—Thor Campbell
*Attorney, Agent, or Firm*—Burns, Doane, Swecker & Mathis, LLP

[57] ABSTRACT

A scroll type fluid machine having a bypass hole structure for capacity control is disclosed. The scroll type fluid machine comprises a first scroll having a first spiral blade, and a second scroll having a second spiral blade. A first fluid working chamber is formed between an inner surface of the first spiral blade, and a second scroll having a second spiral blade. A first fluid working chamber is formed between an inner surface of the first spiral blade and an outer surface of the second spiral blade, and a second fluid working chamber is formed between an outer surface of the first spiral blade and an inner surface of the second spiral blade. A winding end of the first spiral blade is extended so that the first fluid working chamber and the second fluid working chamber open and close with respect to a single low-pressure port. A common bypass hole making the first and second fluid working chambers communicate with the low-pressure port in common is provided.

15 Claims, 5 Drawing Sheets

SCROLL TYPE FLUID MACHINE

TECHNICAL FIELD

The present invention relates to a scroll type fluid machine which is mainly employed as a refrigerant compressor for an air conditioner or a refrigerator, and more particularly, it relates to a scroll type fluid machine having a bypass hole structure for capacity control.

BACKGROUND TECHNIQUE

A scroll type fluid machine having a bypass hole structure is disclosed in Japanese Patent Publication No. 2-55636, for example. In the scroll type fluid machine disclosed in this gazette, symmetrical fluid working chambers of two systems are formed between a pair of scrolls having symmetrical shapes, and bypass holes are provided in these fluid working chambers of the respective systems.

FIG. 5 illustrates sectional views of the pair of scrolls of the aforementioned conventional scroll type fluid machine. The scroll type fluid machine comprises a non-revolving scroll F and a revolving scroll O. First fluid working chambers A are formed between an inner surface Fa of a spiral blade of the non-revolving scroll F and an outer surface Ob of a spiral blade of the revolving scroll O, and second fluid working chambers B are formed between an outer surface Fb of the spiral blade of the non-revolving scroll F and an inner surface Oa of the spiral blade of the revolving scroll O. Bypass holes AH and BH are provided in correspondence to these fluid working chambers A and B of two systems respectively.

One bypass hole AH is that making outer peripheral side first fluid working chambers A1 to A3 communicate with a low-pressure port L, and the other bypass hole BH is that making outer peripheral side second fluid working chambers B1 to B3 communicate with the low-pressure port L. The two bypass holes AH and BH open and close at the same timing through bypass valves respectively. Work (a compression step in case of a compressor) can be started from inner peripheral side first fluid working chambers A4 to A6 and second fluid working chambers B4 to B6 by providing the bypass holes AH and BH, and a working fluid is discharged to a high-pressure port H in a state reducing the capacity.

In the conventional scroll type fluid machine shown in FIG. 5, the bypass holes AH and BH are provided in correspondence to the respective fluid working chambers A and B respectively. Further, the bypass valves and operating pressure mechanisms operating these bypass valves are also necessary in two sets respectively in correspondence to the two bypass holes AH and BL, and working portions increase in number as a whole, while the number of parts also increases. Thus, the machine becomes inferior in manufacturability and reliability.

In order to solve the aforementioned problem, it is conceivable, not to provide bypass holes in correspondence to the respective fluid working chambers A and B respectively, but to provide a single large bypass hole. For example, it is conceivable to provide a large bypass hole CH shown by phantom lines in FIG. 5. In case of providing the single large bypass hole CH in the conventional scroll type fluid machine shown in FIG. 5, it comes to that the inner peripheral side second fluid working chamber B4 which must work at an angle of rotation within the range of 0 to $\pi$ radian about $\pi/2$ radian inevitably communicates with the low-pressure port L. Therefore, the single bypass hole CH cannot be provided in the conventional scroll type fluid machine shown in FIG. 5.

In other words, the conventional scroll type fluid machine comprising the pair of scrolls having the shapes shown in FIG. 5 is forced to be provided with the two bypass holes AH and BH. It is apprehended that the working fluid leaks from peripheral portions of the two bypass holes AH and BH in full-load driving closing these two bypass holes AH and BH. When such leakage takes place, loss of the performance increases. When a liquid refrigerant of a non-compressive fluid or oil gets mixed into the fluid working chambers in large quantities, if a lag is caused in the timing for opening the two bypass holes AH and BH, and if the volume of the operating pressure chamber for the bypass valve opening earlier reduces, the pressure in the operating pressure chamber for the bypass valve delayed in opening operation increases, the opening operation is further delayed, and discharge of the liquid cannot be smoothly performed.

DISCLOSURE OF THE INVENTION

An object of the present invention is to reduce the number of bypass holes and attain simplification of the structure by providing a bypass hole common to fluid working chambers of two systems.

Another object of the present invention is to reduce leakage of a working fluid from a bypass hole portion.

Still another object of the present invention is to prevent a delay in liquid discharge by a lag in operation timing of a bypass valve.

A scroll type fluid machine to be a premise of the present invention comprises a first scroll having a first spiral blade, and a second scroll having a second spiral blade which is in sliding contact with the first spiral blade. A first fluid working chamber is formed between an inner surface of the first scroll blade and an outer surface of the second scroll blade, and a second fluid working chamber is formed between an outer surface of the first spiral blade and an inner surface of the second spiral blade.

In the aforementioned scroll type fluid machine, the present invention is characterized in the following:

Namely, the winding end of the first spiral blade is so extended that the first fluid working chamber and the second fluid working chamber open and close with respect to a single low-pressure port. Further, a common bypass hole making the first and second fluid working chambers communicate with the low-pressure port in common is provided.

In one preferred embodiment, a difference of at least $\pi$ radian in involute angle is provided between the winding end of the first spiral blade and the winding end of the second spiral blade. Preferably, the common bypass hole has an opening in an inner side region of the first spiral blade positioned up to a point rewound inward by $2\pi$ radian in involute angle from an outermost contact point between the first spiral blade and the second spiral blade.

In one embodiment, the common bypass hole includes a first bypass hole and a second bypass hole which are provided separately from each other. Each of the first and second bypass holes has an opening in an inner side region of the first spiral blade positioned up to a point rewound inward by $2\pi$ radian in involute angle from an outermost contact point between the first spiral blade and the second spiral blade.

In another embodiment, the common bypass hole includes a first bypass hole and a second bypass hole which are provided separately from each other. The first bypass hole has an opening in an inner side region of the first spiral blade positioned up to a point rewound inward by $2\pi$ radian in involute angle from an outermost contact point between the first spiral blade and the second spiral blade. The second bypass hole has an opening in an inner side region of the first spiral blade positioned at a point further rewound inward beyond the point rewound inward by 2π radian in involute angle from the said outermost contact point.

Preferably, the common bypass hole has an opening width of the same size as the distance between opposite inner and outer surfaces of the first spiral blade. Typically, the common bypass hole is a circular hole.

In one embodiment, a bypass valve opening and closing a passage connecting the common bypass hole with the low-pressure port is provided. The bypass valve has a plunge part plunging into the common bypass hole and reducing a dead volume caused by this bypass hole.

Preferably, a high-pressure port is provided at the center of the first spiral blade. This high-pressure port has a shape making the first fluid working chamber communicate with the high-pressure port in advance of the second fluid working chamber.

Typically, the first scroll is a non-revolving scroll, and the second scroll is a revolving scroll.

BEST MODES FOR CARRYING OUT THE INVENTION

Figure 1:
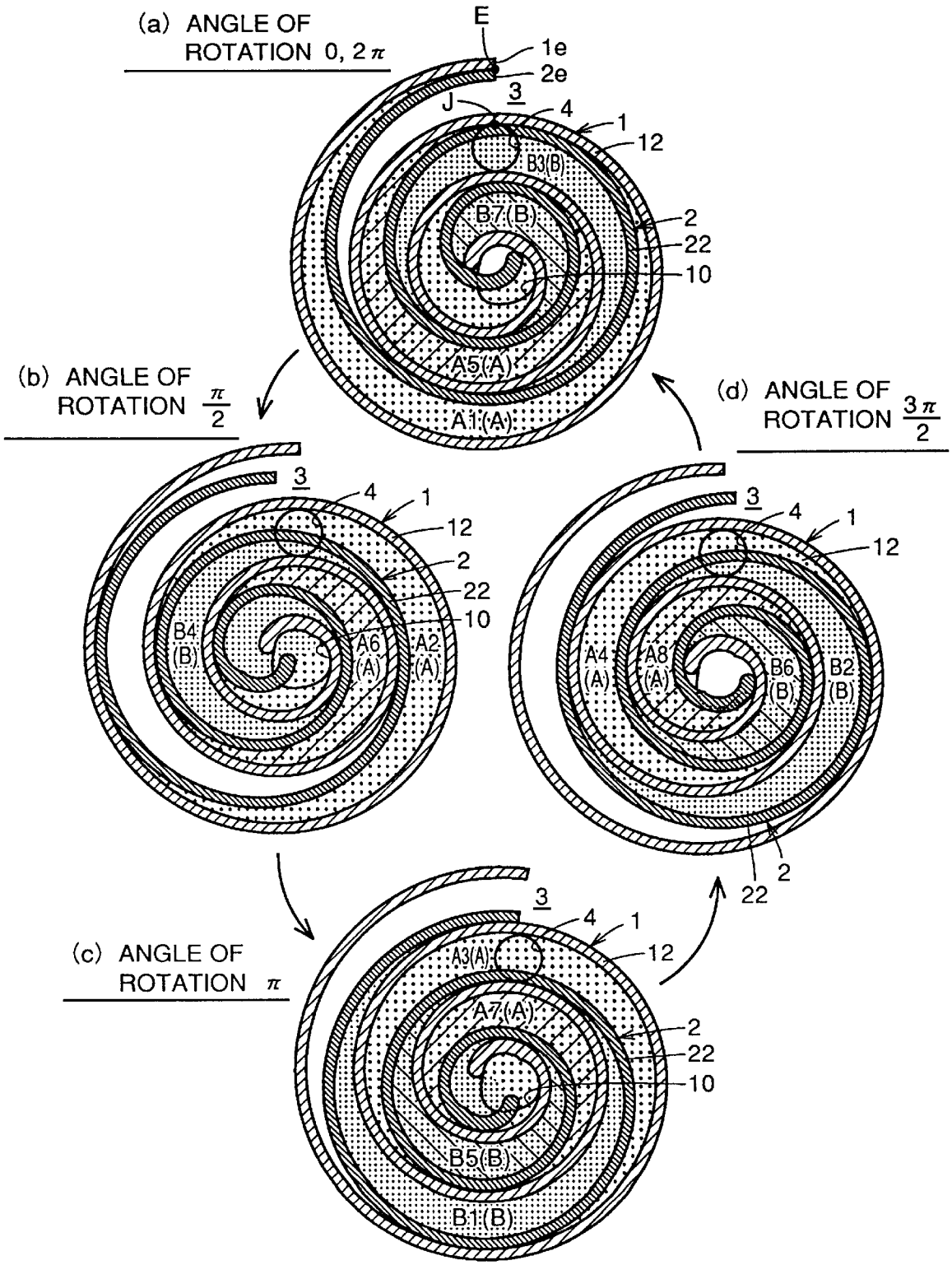
FIG. 1 is cross-sectional views showing a pair of scrolls according to an embodiment of the present invention, and successively shows a compressing operation.

Referring to FIG. 1, a scroll type fluid machine according the present invention comprises a first scroll 1 having a first spiral blade 12, and a second scroll 2 having a second spiral blade 22 which is in sliding contact with the first spiral blade 12. In this embodiment, the first scroll 1 is a non-revolving scroll, and the second scroll 2 is a revolving scroll. First fluid working chambers A are formed between an inner surface of the first spiral blade 12 of the first scroll 1 and an outer surface of the second spiral blade 22 of the second scroll 2. Second fluid working chambers B of a different system from the first fluid working chambers A are formed between an outer surface of the first spiral blade 12 and an inner surface of the second spiral blade 22.

As shown in FIG. 1, the first fluid working chambers A are compressed in order of A1-A2-A3-A4-A5-A6-A7-A8. Similarly, the second fluid chambers B are compressed in order of B1-B2-B3-B4-B5-B6-B7.

In the embodiment shown in FIG. 1, a winding end 1*e* of the first spiral blade 12 is so extended that the first fluid working chambers A and the second fluid working chambers B open and close with respect to a single low-pressure port 3. In the illustrated embodiment, a difference of at least π radian in involute angle is provided between the winding end 1*e* of the first spiral blade 12 and a winding end 2*e* of the second spiral blade 22. To provide the difference of at least π radian in involute angle means that, in relation to the number of turns, the first spiral blade 12 of the first scroll 1 is longer by at least a half turn than the second spiral blade 22 of the second scroll 2. Thus, the first spiral blade 12 of the first scroll 1 and the second spiral blade 22 of the second scroll 2 form the so-called asymmetrical spirals.

In a scroll type compressor which is a typical example of the scroll type fluid machine, the fluid working chambers A and B form compression chambers, and refrigerant gas which is a compressible fluid or the like is employed as the working fluid therefor.

The illustrated scroll type fluid machine is provided with a common bypass hole 4 making the first and second fluid working chambers A and B communicate with the low-pressure port 3 in common. According to this embodiment, the common bypass hole 4 has an opening width of the same size as the distance between opposite inner and outer surfaces of the first spiral blade 12. When the common bypass hole 4 is a circular hole positioned between the blades as illustrated, the common bypass hole can be provided simply by making perforation. The circular hole means that the opening cross-sectional shape of the common bypass hole 4 is circular.

The first spiral blade 12 and the second spiral blade 22 have shapes coinciding with an involute of a circle, i.e., an involute curve, in general. However, there are many cases where the spiral central portion, particularly the inner surface of the spiral is trimmed with one or a plurality of circular arcs, or trimmed with a straight line, as illustrated. A high-pressure port 10 is provided at the center of the first spiral blade 12.

The common bypass hole 4, which opens the two systems of chambers of the first fluid working chambers A and the second fluid working chambers B in common, is not restricted to a case of being formed by a single hole alone, but may be formed by a plurality of holes. While the common bypass hole 4 is single in the embodiment shown in FIG. 1, a plurality of common bypass holes are provided in embodiments shown in FIGS. 3 and 4.

According to the illustrated embodiment of the present invention, the first spiral blade 12 of the first scroll 1 and the second spiral blade 22 of the second scroll 2 are formed into the so-called asymmetrical spirals, whereby the two systems of chambers of the first and second fluid working chambers A and B formed between both spirals can be excellently opened with respect to the low-pressure port 3 through the common bypass hole 4. At this time, the chambers to work which are positioned on inner sides of the spirals are not made to communicate with the low-pressure port 3. Thus, the number of perforation can be reduced, the numbers of bypass valves for opening an closing the bypass holes and operating pressure mechanisms therefor can also be reduced by providing the common bypass hole 4 opening the fluid working chambers A and B for two systems to the low-pressure port 3 together, and simplification of the structure can be attained. Further, leakage of a fluid through the bypass hole portion can be reduced since the number of the bypass hole is reduced, and it is also possible to improve reliability. In addition, a delay of liquid discharge caused by a lag in open/close timing for the bypass hole can also be eliminated, and breakage accident of the scroll portions and the like can be prevented by ensuring excellent liquid discharge.

As hereinabove described, the difference of at least π radian in involute angle is provided between the winding end 1*e* of the first spiral blade 12 of the first scroll and the winding end 2*e* the second spiral blade 22 of the second scroll 2. Therefore, a phase difference of π radian forms between an angle of rotation (0 radian) at which the first fluid working chambers A are closed up with respect to the low-pressure port 3 and an angle of rotation (π radian) at which the second fluid working chambers B are closed up with respect to the low-pressure port 3. While the difference of just π radian is provided between the winding end le of the first spiral blade and the winding end 2*e* of the second spiral blade in the embodiment shown in FIG. 1, FIG. 3 or FIG. 4, the aforementioned relation remains also when the winding end 1*e* of the first spiral blade 12 of the first scroll 1 is further extended to provide a phase difference exceeding π radian. Thus, in the embodiment of the present invention of the asymmetrical spirals in which it comes to that the pressure relation between the fluid working chambers A and B of the respective systems has a phase difference of about half rotation, the fluid working chambers A and B of two systems can be opened and closed to the low-pressure port 3 by the common bypass hole 4, and the intended objects can be achieved.

The common bypass hole 4 has an opening in an inner side region of the first spiral blade 12 positioned up to a point J rewound inward by 2π radian in involute angle from an outermost contact point E between the first spiral blade 12 of the first scroll 1 and the second spiral blade 22 of the second scroll 2, for example. The point J rewound inward by 2π radian in involute angle from the outermost contact point E indicates a point rewound inward by substantially one turn from the outermost contact point E. In the embodiment shown in FIG. 1, the common bypass hole 4 has the opening at the point J which is an inner limit point. Thus, it comes to that the working chamber A1 is made to communicate with the suction port (low-pressure port) 3 through the common bypass hole 4 from immediately after the first fluid working chamber A1 is closed up with respect to the low-pressure port 3 (step a), whereby unnecessary performance of work in the first fluid working chambers A can be avoided in a bypass time, and loss of the work can be reduced. Further, one partial capacity control value can be implemented by providing the common bypass hole 4 having the opening in the aforementioned region.

Figure 3:
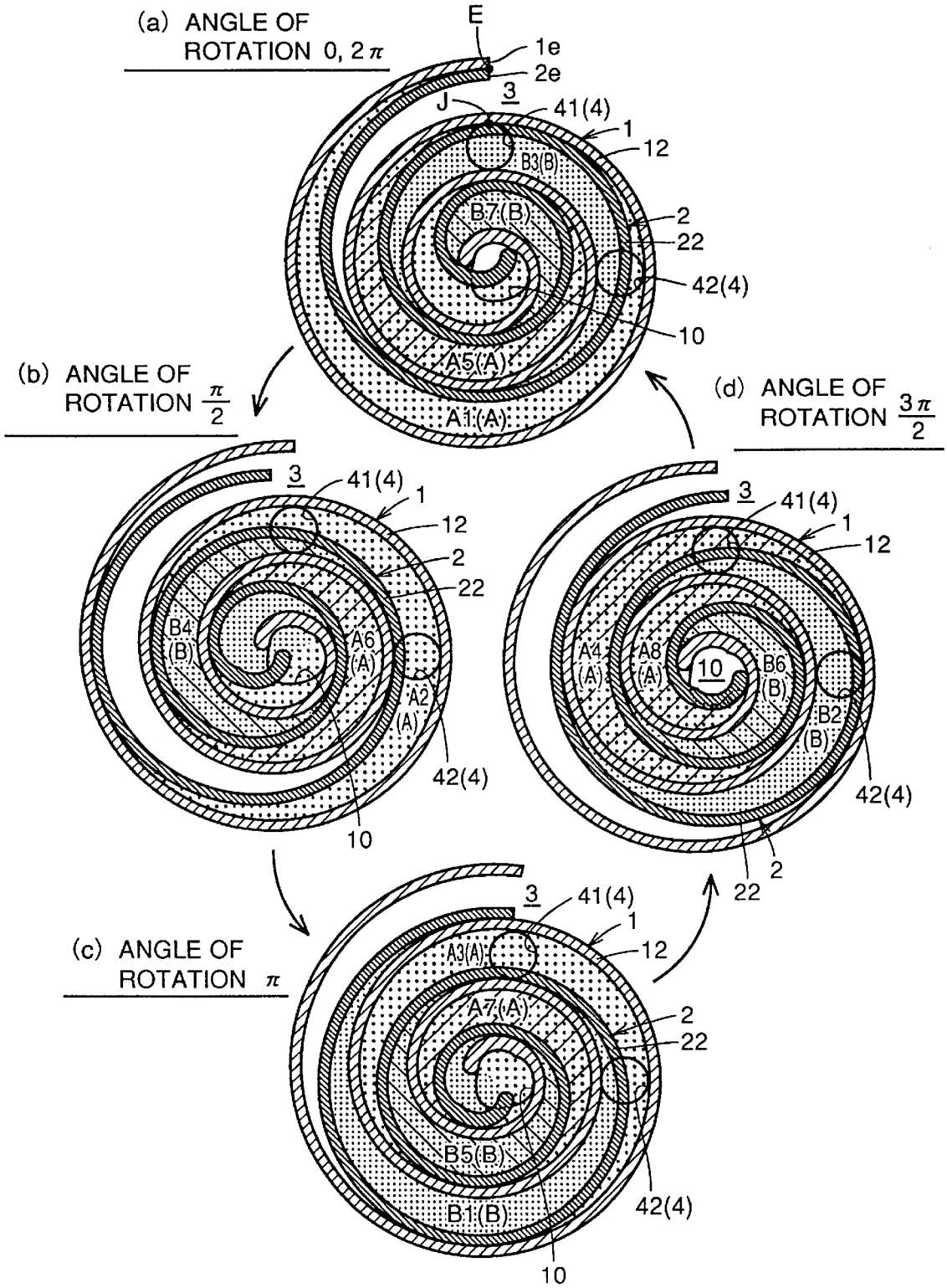
FIG. 3 is cross-sectional views showing a pair of scrolls according to another embodiment of the present invention, and successively shows a compressing operation.

In the embodiment shown in FIG. 3, two common bypass holes 41 and 42 are provided. These first and second bypass holes 41 and 42 have openings in inner side regions of a first spiral blade 12 positioned up to a point J rewound inward by 2π radian in involute angle from an outermost contact point E between the first spiral blade 12 and a second spiral blade 22 respectively. Therefore, unnecessary work in first fluid working chambers A can be avoided in a bypass time and loss of the work can be reduced, similarly to the embodiment shown in FIG. 1. Further, it is possible to make the work performed from regions provided with dots and slant lines in FIG. 3 by opening only the bypass hole 42 on an outer side of the spirals, and it is possible to obtain such capacity control values that a reduced capacity is small and an actual work capacity is large as compared with a case of opening the bypass hole 41 on an inner side of the spirals. Thus, a plurality of partial capacity control values can be obtained by providing a plurality of bypass holes 41 and 42. While two bypass holes 41 and 42 have been provided in the embodiment shown in FIG. 3, at least three bypass holes may be provided.

Figure 4:
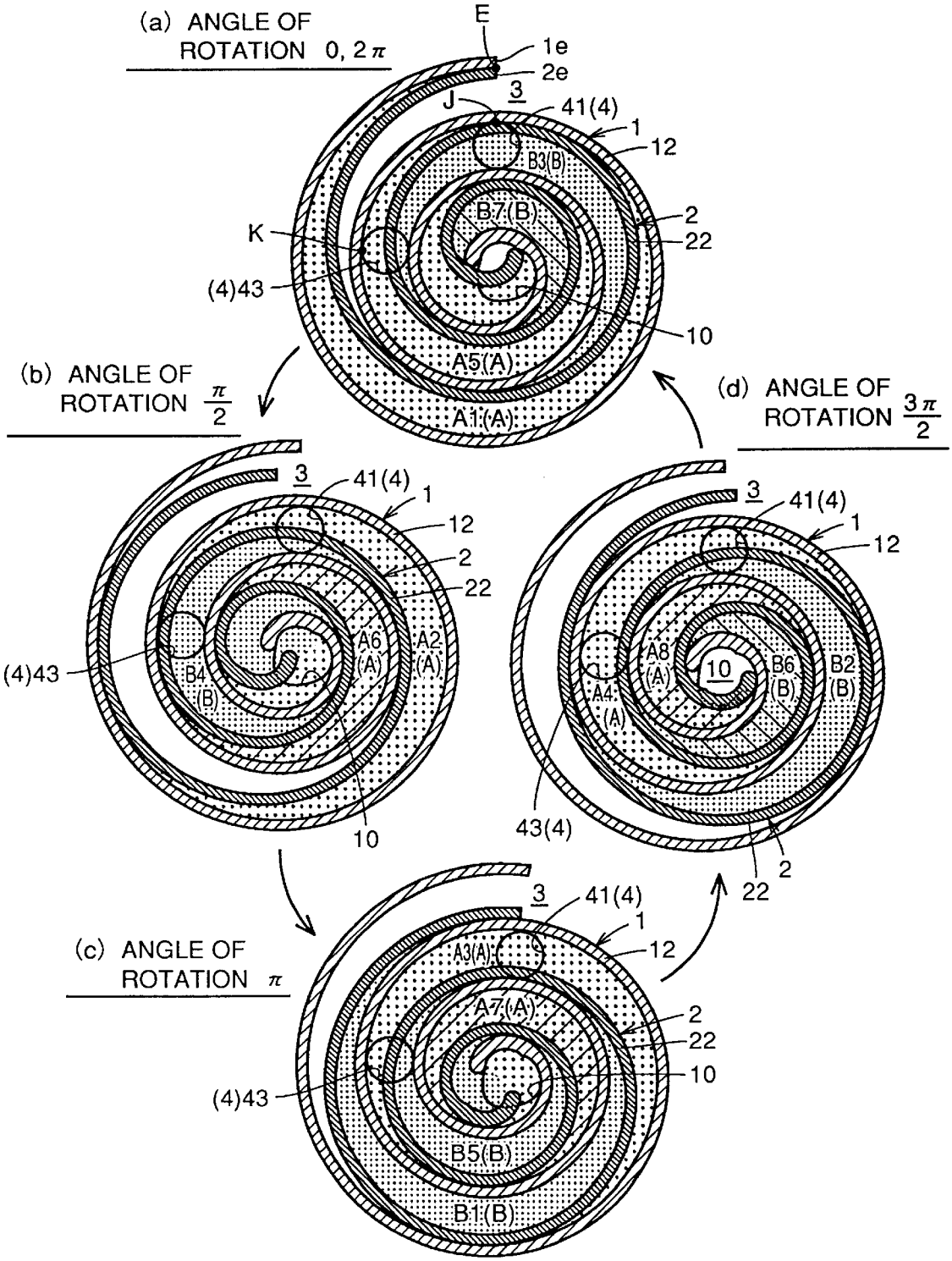
FIG. 4 is cross-sectional views showing a pair of scrolls according to still another embodiment of the present invention, and successively shows a compressing operation.
Figure 5:
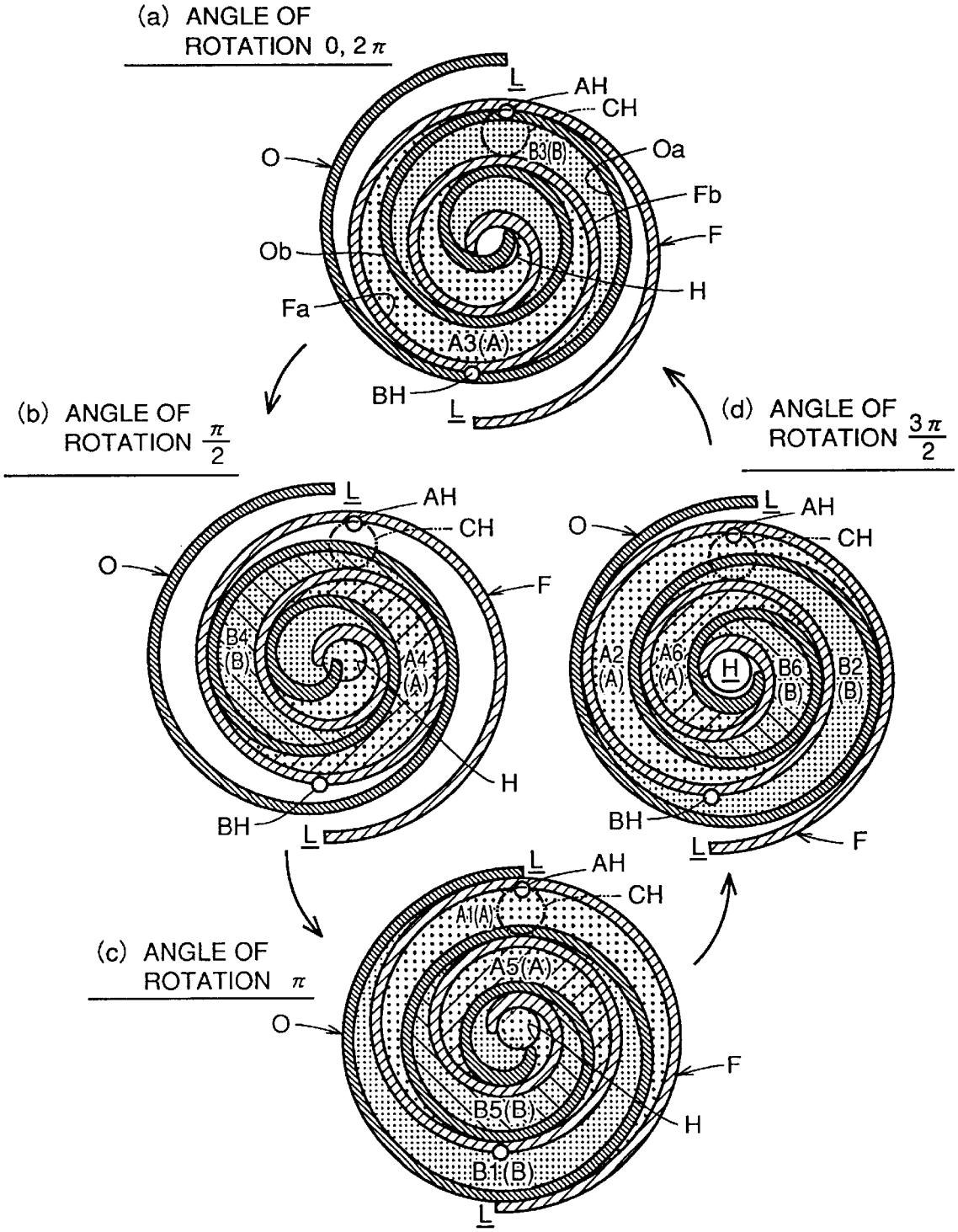
PRIOR ART FIG.5
FIG. 5 is cross-sectional views of a conventional pair of scrolls, and successively shows a compressing operation.

Also in the embodiment shown in FIG. 4, two common bypass holes 41 and 43 are provided. One bypass hole 41 has an opening in an inner side region of a first spiral blade 12 positioned up to a point J rewound inward by 2π radian in involute angle from an outermost contact point E between a first spiral blade 12 of a first scroll 1 and a second spiral blade 22 of a second scroll 2. In this embodiment, the first bypass hole 41 is formed just at the point J. The other second bypass hole 43 has an opening in an inner side region of the first spiral blade 12 positioned at a point K further rewound inward beyond the point J rewound inward by 2π radian in involute angle from the outermost contact point E. By providing such common bypass holes, it is possible to avoid unnecessary work in first fluid working chambers A in a bypass time and loss of the work can be reduced, similarly to the embodiment shown in FIG. 3. Further, the work can be made performed from regions provided with dots and slant lines in FIG. 4 by opening the second bypass hole 43 on the inner side of the spirals with respect to a low-pressure port 3 along with the first bypass hole 41 on an outer side of the spirals, and it is possible to obtain such capacity control values that a reduced capacity is large and an actual work capacity is small as compared with a case of opening only the bypass hole 41 on the outer side of the spirals. Thus, a plurality of partial capacity control values can be obtained by providing the first bypass hole 41 and the second bypass hole 43, and a partial capacity control value of a particularly small capacity can also be implemented. The number of the common bypass holes is not restricted to two, but may be at least three. In this case, at least two bypass holes may be provided in either region inside or outside the point J.

While the number of the common bypass holes may be plural, at least one common bypass hole has an opening in the inner side region of the first spiral blade 12 positioned up to the point J rewound inward by 2π radian in involute angle from the outermost contact point E between the first spiral blade 12 and the second spiral blade 22. Preferably, the common bypass hole is made to have an opening width of the size of the distance spread between opposite inner and outer surfaces of the first spiral blade 12 of the first scroll 1, whereby the working chamber B1 can be made to communicate with the suction port (low-pressure port) 3 through the common bypass hole 4 from immediately after the second fluid working chamber B1 is closed up with respect to the low-pressure port (step c) through the common bypass hole 4, also when the common bypass hole is formed at the point J which is an inner side limit as shown in FIG. 1 (under most strict condition). Thus, it is possible to avoid unnecessary performance of work also in the second fluid working chambers B in the bypass time, and loss of the work can be further reduced. Further, the common bypass hole 4 employs an opening width spreading between the opposite inner and outer surfaces of the first spiral blade 12 of the first scroll 1 and its opening area is made as large as possible, whereby communication between the fluid working chambers A and B and the low-pressure port 3 through the common bypass hole 4 can be rendered smooth with no resistance. The distance between the opposite inner and outer surfaces of the first spiral blade 12 of the first scroll 1 becomes a length of $2\pi r-t$, assuming that r represents the radius of the base circle of the involute forming the spiral blade and t represents the thickness of the spiral blade.

The embodiment shown in FIG. 1, FIG. 3 or FIG. 4 makes the spiral blades of a pair of scrolls asymmetrical spirals, for reducing a bad influence caused when it is decided to provide a circular high-pressure port at the central portion of the spirals. Namely, it is intended to reduce such a bad influence that an angle of rotation possessed by the first fluid working chambers A before communicating with the high-pressure port becomes too large as compared with the second fluid working chambers B and pressure impact takes place at the time of communication with the high-pressure port. In the embodiment shown in FIG. 1, FIG. 3 or FIG. 4, the high-pressure port 10 is in such a shape that the first fluid working chamber A8 on the spiral center side facing the high-pressure port 10 opens to the high-pressure port 10 in advance of the second fluid working chamber B7, whereby excessive containment on the side of the first fluid working chambers A can be eliminated, and pressure impact at the time of communication with the high-pressure port 10 can be relaxed. The high-pressure port 10 is generally formed by a fluid passage hole opening at the central portions of the scrolls 1 and 2, and called a discharge hole or the like in case of a compressor.

Figure 2:
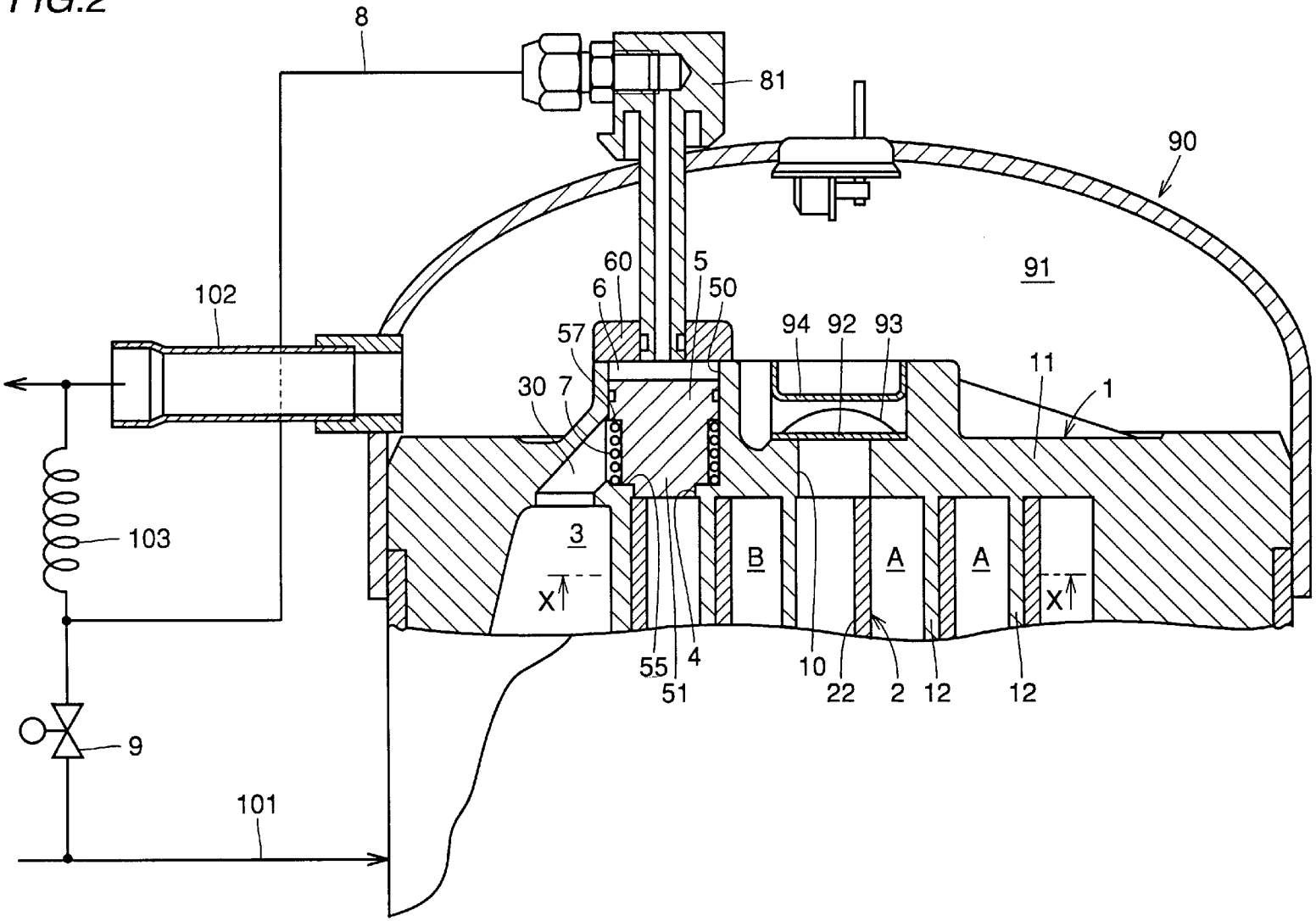
FIG. 2 is a longitudinal sectional view of the embodiment of the present invention.

Referring to FIG. 2, the structure of a longitudinal section of the scroll type fluid machine is described. FIG. 1 is a cross-sectional view as viewed along the line X—X in FIG. 2.

The first scroll 1 which is a non-revolving scroll and the second scroll 2 which is a revolving scroll are arranged in an upper region in the interior of a closed casing 90. The first scroll 1 comprises an end plate, i.e., a base plate 11, and the first spiral blade 12 projectingly provided on this base plate 11. The first spiral blade 12 has a shape coinciding with an involute curve. Also the second scroll 2 which is a revolving scroll similarly comprises a base plate (not shown) and the second spiral blade 22 provided on this base plate. The second spiral blade 22 has a shape coinciding with an involute curve.

The first fluid working chambers A and the second fluid working chambers B are formed between the first spiral blade 12 and the second spiral blade 22. Low-pressure gas introduced in a lower space of the casing 90 from a low-pressure line 101 formed by a suction pipe is taken into the respective working chambers A and B from the single low-pressure port 3 on the outer peripheral portions of the spiral blades. High-pressure gas after compression is to be taken out to a high-pressure line 102 formed by a discharge pipe from the high-pressure port 10 which is a discharge hole having an opening at the central portion of the first scroll 1 through a discharge dome 91. A discharge valve 92, a valve spring 93 and a valve guard 94 are provided in the opening portion of the high-pressure port 10.

In the embodiment shown in the figure, a valve hole 50 consisting of a circular hole is formed in continuation to the common bypass hole 4. A bypass passage 30 communicating with the low-pressure port 3 is provided on a side portion of this valve hole 50. A stepped cylindrical bypass valve 5 for opening and closing the common bypass hole 4 is slidably inserted in the valve hole 50. A plunge part 51 consisting of a small cylinder is provided on a forward end portion of the bypass valve 5. This plunge part 51 plunges into the common bypass hole 4, and reduces a dead volume by this bypass hole 4.

A bypass spring 7 consisting of a coil spring is in contact with a stepped part 57 of the bypass valve 5. An operating pressure chamber 6 of the bypass valve 5 is divided from the discharge dome 91 by a lid body 60. The operating pressure chamber 6 is connected to an operating pressure line 8 through a joint pipe 81, and this operating pressure line 8 is to selectively communicate with the low-pressure line 101 or the high-pressure line 102 by switching means 9 consisting of an electromagnetic valve. Reference numeral 103 denotes decompression means such as a capillary tube preventing short-circuiting of the high- and low-pressure lines.

The dead volume by the common bypass hole 4 mainly means a waste volume caused by the fall between a seat surface 55 of the bypass valve 5 and an opening end surface of the common bypass hole 4 on the fluid working chamber side. Volume loss in the common bypass hole 4 portion can be made as small as possible by providing the plunge part 51 on the bypass valve 5.

In the embodiment shown in FIG. 1 and FIG. 2, the common bypass hole 4 is single, to obtain one partial capacity control value (capacity value of about 60% with respect to 100% in a total capacity time). While the common bypass holes are formed by the two holes of the hole 41 at the point rewound inward by $2\pi$ radian in involute angle from the outermost contact point E and the point 42 at the point similarly rewound by $3\pi/2$ radian in the embodiment shown in FIG. 3, a capacity value of about 70% for opening only the hole 42 on the outer side of the spirals can also be obtained in this case. Further, when the common bypass holes are formed by two holes of the hole 41 at the point rewound inward by $2\pi$ radian in involute angle from the outermost contact point E and the hole 43 at the point similarly rewound by $5\pi/2$ radian as in the embodiment shown in FIG. 4, a capacity value of about 50% for opening all holes 41 and 43 can also be obtained.

In the embodiments shown in FIG. 1 to FIG. 4, the first scrolls 1 are non-revolving scrolls, and the second scrolls 2 are revolving scrolls. The non-revolving scroll, as to which the so-called fixed scroll fixed to a stationary member is typical, also includes a scroll allowing only movement in an axial direction with respect to a stationary member. The revolving scroll means a scroll revolving at a prescribed radius of turn in a state inhibited from rotation, and it may also be called a movable scroll, a swing scroll or the like.

While concrete embodiments of the present invention have been described with reference to the drawings, the present invention is not restricted to the illustrated embodiments, but various corrections and modifications are possible within the even range of the present invention defined in claims.

Industrial Availability

The present invention can be advantageously applied to a scroll type fluid machine employed for a refrigerant compressor of an air conditioner or a refrigerator.

What is claimed is:

1. A scroll type fluid machine comprising a first scroll having a first spiral blade and a second scroll being in sliding contact with the first spiral blade, and forming a first fluid working chamber between an inner surface of the first spiral blade and an outer surface of the second spiral blade while forming a second fluid working chamber between an outer surface of the first spiral blade and an inner surface of the second spiral blade, extending a winding end of said first spiral blade so that said first fluid working chamber and said second fluid working chamber open and close with respect to a single low-pressure port, and providing a common bypass hole making said first and second fluid working chambers communication with said single low-pressure port in common.

2. The scroll type fluid machine in accordance with claim 1, wherein a difference of at least $\pi$ radian in involute angle is provided between the winding end of said first spiral blade and a winding end of said second spiral blade.

3. The scroll type fluid machine in accordance with claim 1, wherein said common bypass hole has an opening in an inner side region of said first spiral blade being positioned up to a point rewound inward by $2\pi$ radian in involute angle from an outermost contact point between said first spiral blade and said second spiral blade.

4. The scroll type fluid machine in accordance with claim 1, wherein said common bypass hole includes a first bypass hole and a second bypass hole being provided separately from each other, and said first and second bypass holes have openings in inner side regions of said first spiral blade (12) being positioned up to a point rewound inward by 2π radian in involute angle from an outermost contact point between said first spiral blade (12) and said second spiral blade respectively.

5. The scroll type fluid machine in accordance with claim 1, wherein said common bypass hole includes a first bypass hole and a second bypass hole being provided separately from each other, said first bypass hole has an opening in an inner side region of said first spiral blade being positioned up to a point rewound inward by 2π radian in involute angle from an outermost contact point between said first spiral blade and said second spiral blade, and said second bypass hole has an opening in an inner side region of said first spiral blade being positioned at a point further rewound inward beyond said point rewound inward by 2π radian in involute angle from said outermost contact point.

6. The scroll type fluid machine in accordance with claim 1, wherein said common bypass hole has an opening width of the same size as the distance between opposite inner and outer surfaces of said first spiral blade.

7. The scroll type fluid machine in accordance with claim 6, wherein said common bypass hole is a circular hole.

8. The scroll type fluid machine in accordance with claim 1, wherein a bypass valve opening and closing a passage connecting said common bypass hole and said low-pressure port with each other, and said bypass valve has a plunge part plunging into said common bypass hole and reducing a dead volume caused by this bypass hole.

9. The scroll type fluid machine in accordance with claim 1, wherein a high-pressure port is provided at the center of said first spiral blade, and said high-pressure port has a shape making said first fluid working chamber communicate with the high-pressure port in advance of said second fluid working chamber.

10. The scroll type fluid machine in accordance with claim 1, wherein said first scroll is a non-revolving scroll, and said second scroll is a revolving scroll.

11. The scroll type fluid machine in accordance with claim 1, wherein said common bypass hole is a circular hole having an opening in an inner side region of said first spiral blade being positioned up to a point rewound by 2π radian in involute angle from an outermost contact point between said first spiral blade and said second spiral blade, and said circular hole has an opening width of the same size as the distance between opposite inner and outer surfaces of said first spiral blade.

12. The scroll type fluid machine in accordance with claim 1, wherein said common bypass hole has an opening in an inner side region of said first spiral blade being positioned up to a point rewound inward by 2π radian in involute angle from an outermost contact point between said first spiral blade and said second spiral blade, said opening has an opening width of the same size as the distance between opposite inner and outer surfaces of said first spiral blade, a bypass valve opening and closing a passage connecting said common bypass hole and said low-pressure port with each other, and said bypass valve has a plunge part plunging into said common bypass hole and reducing a dead volume caused by this bypass hole.

13. The scroll type fluid machine in accordance with claim 3, wherein said common bypass hole has an opening width of the same size as the distance between opposite inner and outer surfaces of said first spiral blade.

14. The scroll type fluid machine in accordance with claim 4, wherein said common bypass hole has an opening width of the same size as the distance between opposite inner and outer surfaces of said first spiral blade.

15. The scroll type fluid machine in accordance with claim 5, wherein said common bypass hole has an opening width of the same size as the distance between opposite inner and outer surfaces of said first spiral blade.

* * * * *